US006401621B1

(12) United States Patent
Davis et al.

(10) Patent No.: US 6,401,621 B1
(45) Date of Patent: Jun. 11, 2002

(54) ELECTRONIC SAFE AND ARM APPARATUS FOR INITIATING A PYROTECHNIC

(75) Inventors: Bradford S. Davis, Jarrettsville; Edward F. Bukowski, Baltimore; William P. D'Amico, Havre de Grace, all of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/707,289

(22) Filed: Nov. 6, 2000

(51) Int. Cl.[7] ..... F42C 15/26

(52) U.S. Cl. ..... 102/232; 102/248; 102/264; 102/220

(58) Field of Search ..... 102/232, 233, 102/248, 249, 262, 264, 218, 220

(56) References Cited

U.S. PATENT DOCUMENTS 4,145,971 A * 3/1979 Graham et al. ..... 102/232
4,320,704 A * 3/1982 Gawlick et al. ..... 102/218

FOREIGN PATENT DOCUMENTS

AU 265082 * 6/1963 ..... 102/220
DE 3013462 * 10/1981 ..... 102/262

* cited by examiner

*Primary Examiner*—Stephen M. Johnson
(74) *Attorney, Agent, or Firm*—Paul S. Clohan, Jr.

(57) ABSTRACT

An electronic safe and arm apparatus disposed in a projectile having a spin axis and a spin rate includes a battery; a power supply board connected to the battery, the power supply board including a mechanical G-switch that closes permanently at a predetermined acceleration, and a time-delay circuit connected to the G-switch; a firing board connected to the power supply board, the firing board including: an accelerometer that is oriented perpendicular to and disposed a fixed distance from the spin axis, an output of the accelerometer varying according to the fixed distance from the spin axis and the spin rate of the projectile; a comparator connected to the output of the accelerometer wherein the comparator compares the output of the accelerometer to a threshold voltage and an output of the comparator is low when the output of the accelerometer is less than the threshold voltage and the output of the comparator is high when the output of the accelerometer exceeds the threshold voltage; a rectifier connected to the output of the comparator; a firing capacitor, the rectifier being connected between the battery and the firing capacitor whereby when the output of the comparator is high the comparator saturates a gate of the rectifier thereby allowing the firing capacitor to charge; and an initiator connected to an output of the firing capacitor; and a timing board connected to the power supply board and the firing board, the timing board for setting and controlling a predetermined time delay for discharge of the firing capacitor into the initiator.

20 Claims, 4 Drawing Sheets

ELECTRONIC SAFE AND ARM APPARATUS FOR INITIATING A PYROTECHNIC

STATEMENT OF GOVERNMENT INTEREST

The invention described herein may be manufactured and used by or for the Government of the United States of America for government purposes without the payment of any royalties therefor.

BACKGROUND OF THE INVENTION

The present invention relates in general to a safe and arm apparatus and, in particular, to a safe and arm apparatus for use in a projectile, such as a tank round.

U.S. Pat. No. 3,613,595 discloses a tail fuze that uses the air stream and mechanical mechanisms to arm a fuze in flight. U.S. Pat. No. 4,145,971 describes an electronic time delay safety and arming mechanism. The '971 device is a stand alone electronic safe and arm apparatus using a different set of mechanical and electrical means to arm and initiate a fuze, U.S. Pat. No. 4,827,846 relates to an initiating device for a training round. The '846 device uses a mechanical plunger triggered during the flight to arm a mortar training round.

SUMMARY OF THE INVENTION

The present invention includes an electronic safe and arm apparatus that stores electrical energy in a capacitor and delivers this energy at a desired time for initiating a semiconductor bridge initiator. The safe and arm electronic apparatus of the invention is small enough and strong enough to be located inside of the fin or body section of a tank projectile so that it may be used in a tactical, training, or test application. The safe and arm circuit uses a commercially available micromachined microeletromechanical systems (MEMS) accelerometer.

The MEMS accelerometer reacts to its environment mechanically by the movement of a proof mass that converts displacement information into electrical voltages. The electrical voltages are compared by the circuit to a fixed threshold voltage to safely arm the apparatus. Once armed, the apparatus delivers stored energy to an initiator for starting a pyrotechnic, propellant, explosive; or similar combustible train at a pre-set time determined by the user.

The invention is a novel and different way to create a safe and arm apparatus using off-the-shelf commercial products that have been ruggedized to withstand very harsh launch environments, such as tank launch shock and acceleration. At the heart of the apparatus is a solid state micromachined accelerometer and timing circuit. There are safeties built into the apparatus so that the capacitor will not charge until launch and spin environments unique to projectiles are experienced.

Further objects, features and advantages of the invention will become apparent from the following detailed description taken in conjunction with the following drawing.

BRIEF DESCRIPTION OF THE DRAWINGS

Throughout the Figures, reference numerals that are the same refer to the same features.

DETAILED DESCRIPTION OF THE PREFERRED EMBODIMENTS

Figure 1:
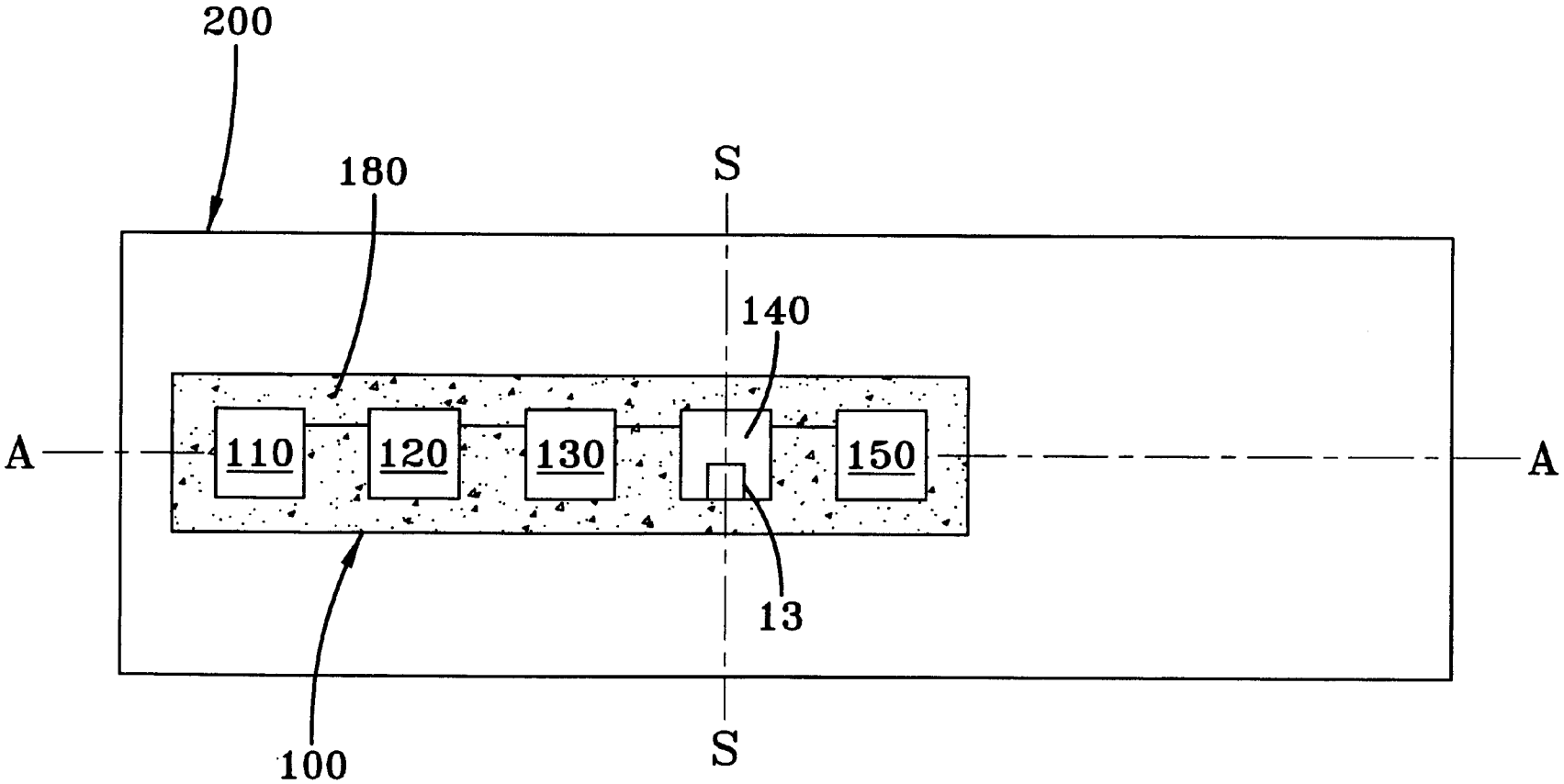
FIG. 1 is a schematic block diagram of the safe and arm apparatus of the invention.

FIG. 1 is a schematic block diagram of the safe and arm apparatus 100 of the invention. The safe and arm apparatus

100 is disposed in a projectile 200, such as a tank round. The projectile 200 has a spin axis AA and, when launched, a spin rate about the spin axis AA. The electronic safe and arm apparatus 100 comprises a battery 110, a battery or power supply board 120, a time delay board 130, a firing board 140 and a pyrotechnic train 150. The firing board 140 includes an accelerometer 13 oriented with its sense axis SS perpendicular to and placed a fixed distance off of the spin axis AA of the projectile 200. Preferably, the apparatus 100 is encapsulated with potting 180, such as STYCAST 1090 potting. Wires are used to connect the boards to one another. The wires strengthen the apparatus 100, provide for electrical vias, and fix the position of the boards and components.

Figure 2A:
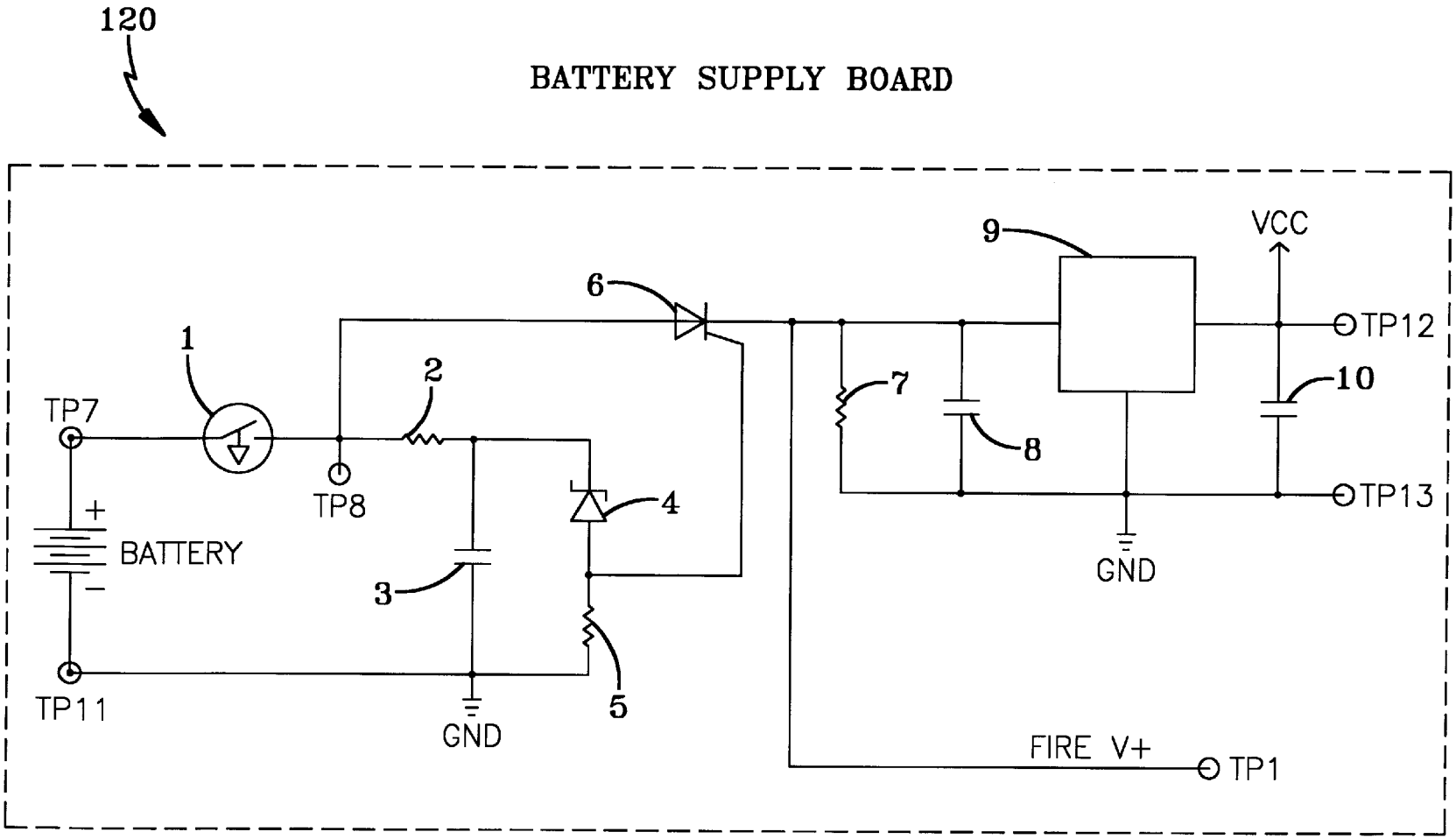
FIGS. 2(A)–(C) are electrical schematics of an embodiment of the invention.
Figure 2B:
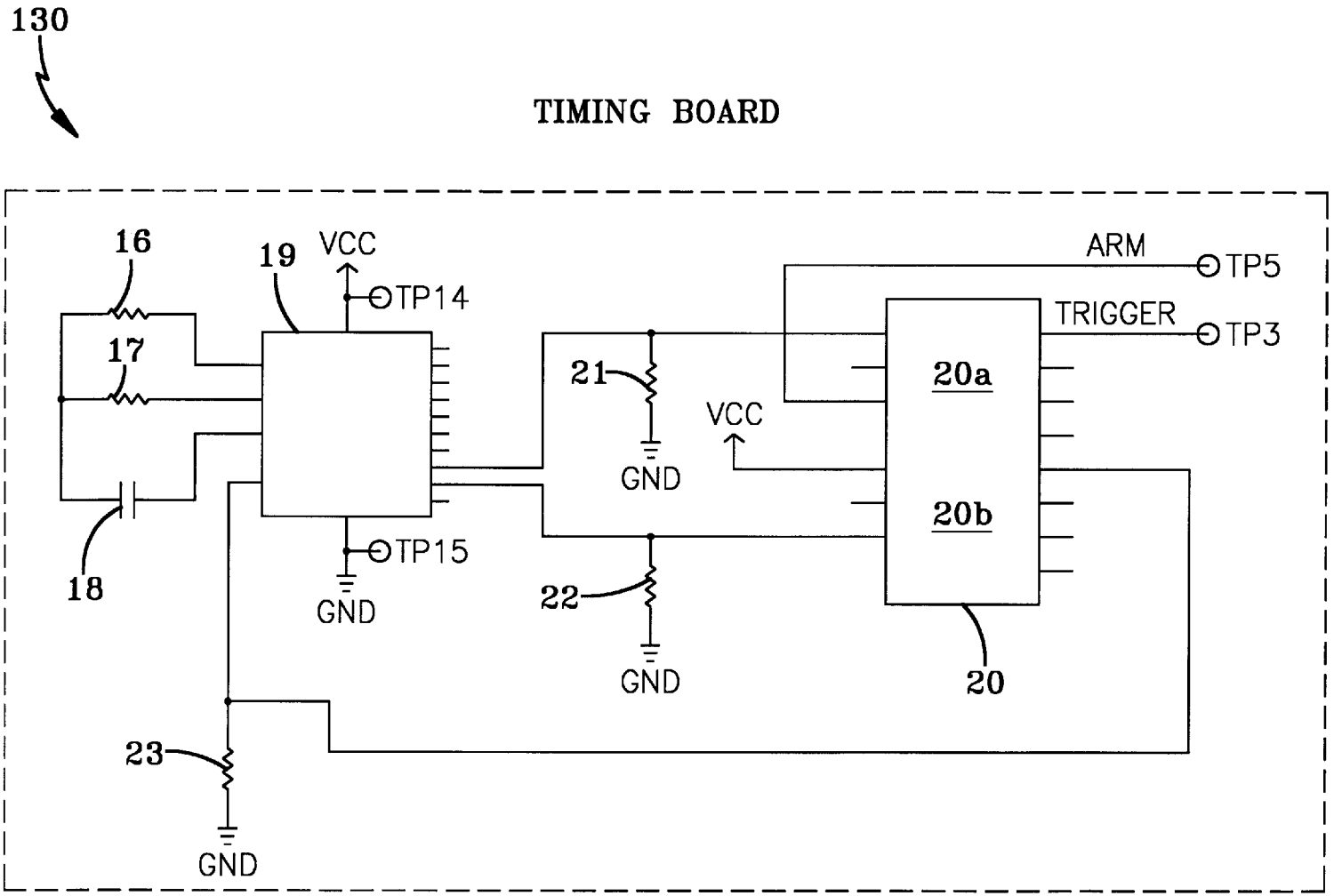
Figure 2C:
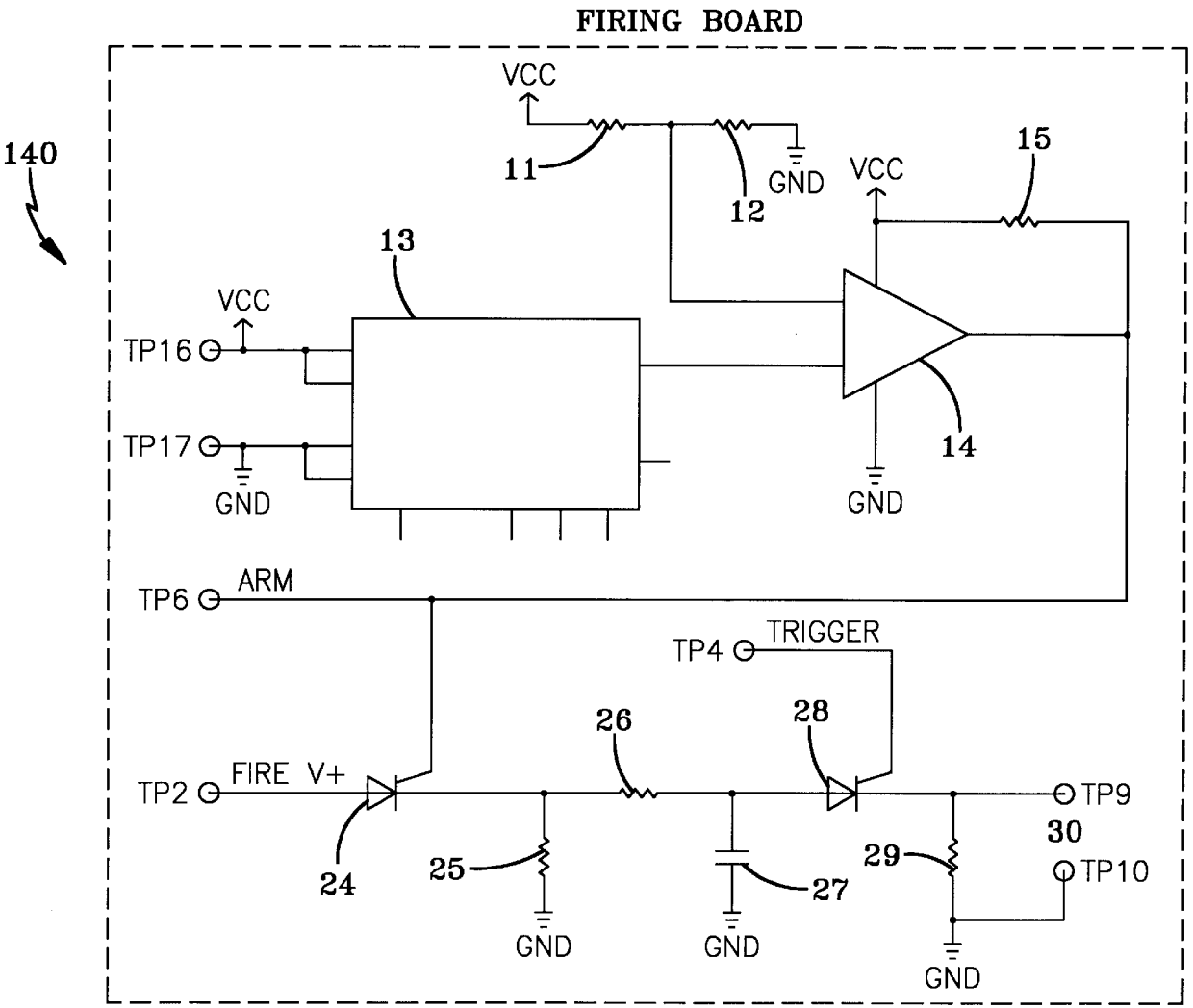

FIGS. 2(A)–(C) are electrical schematics of one embodiment of the apparatus 100 of the invention. The electronic circuit has two safe functions that must be overcome for the circuit to arm. Referring to FIG. 2(A), the first safe is a mechanical g-switch 1 that closes and remains permanently closed at accelerations greater than, for example, 18,000 g's. The open g-switch 1 blocks the electrical energy of the battery from passing into the circuit until the round is shot. Once shot, the g-switch 1 is closed due to the shock, but power is still blocked from the rest of the circuit for about 20 ms (other time delays may be used) in this embodiment. This is due to the combination of a resistor 2 and capacitor 3 connected together along with a zener diode 4, resistor 5, and SCR 6 to create the predetermined circuit turn-on time delay. The turn-on time delay insures that the round is at a safe distance from the gun before any of the arm and fire components are operational. The time delay can be altered. Once the g-switch 1 is closed and 20 ms have passed, a 5 volt regulator 9 powers up the firing board 140 and the timing board 130. Additional capacitors 8, 10 are included to stabilize the output of the regulator 9.

The firing board (FIG. 2(C)) 140 comprises a contact switch or microelectromechanical (MEMS) accelerometer 13 oriented perpendicular to and placed a fixed distance off of the spin axis of the projectile. The output of the accelerometer 13 is ultimately controlled by its offset from the axis of rotation and the spin rate of the projectile following the physics of centrifugal acceleration. The accelerometer 13 output is connected to a comparator 14 which compares the accelerometer output voltage to a threshold voltage created by a voltage divider made up of two resistors 11, 12. The output of the comparator 14 will remain "low" until the output voltage of the accelerometer 13 is greater than the threshold voltage.

When the projectile begins to spin, the accelerometer 13 senses the radial acceleration and its output becomes greater than the threshold voltage thereby sending the output of the comparator 14 "high". In one embodiment, the accelerometer 13 was placed 1.7 mm off of the spin axis such that a 30 Hz spin rate would cause its output to exceed the threshold. Distances and spin rates other than 1.7 mm and 30 Hz may be used, depending on the application. Once this happens, the output of the comparator 14 saturates the gate of a silicon controlled rectifier (SCR) 24 connected between the firing capacitor 27 (such as a tantalum capacitor) and the battery voltage thereby allowing the capacitor 27 to charge. The charge time of the capacitor 27 is set by a resistor 26 connected in series with the capacitor 27. However, the capacitor 27 will only remain charged while the projectile is spinning. If the SCR 24 does not remain saturated, the capacitor 27 will discharge into a drain resistor 25. This is the second fail safe because the spinning motion of the round while in flight is needed to both arm and fire the initiator.

The output of the comparator 14, when "high", also enables a D flip-flop 20*a* on the timing board 130 (FIG.

2(B)). The firing board 140 and the timing board 130 are powered at the same time. The timing board 130 includes a 14 bit counter 19 and a quad latch chip with several D flip-flops 20*a,b*. Once powered, the 14 bit counter 19 begins to count up. Bit 12 of the counter 19 is connected to the data input of a D flip-flop 20*a* and will go to a logic level "high" after a predetermined time. This time delay is based on the clock frequency of the counter which is set by two resistors 16, 17 and a capacitor 18. Bit 13 on the counter 19 is connected to the enable input of another D flip-flop 20*b* and will go "high" after bit 12 does. Since the data input of the D flip-flop 20*b* is always "high", the output of the D flip-flop 20*b* will go high and remain high even after the enable input goes low. The output of the D flip-flop 20*b* is connected to the reset input of the counter 19, and when "high", it will reset the counter 19 and stop it.

The enable input of the first D flip-flop 20*a* is connected to the output of the comparator 14 which will be "high" when the round is spinning. After the predetermined time delay, bit 12 of the counter 19 will send a logic "high" into the data input of the D flip-flop 20*a*. Since the D flip-flop 20*a* is enabled by the comparator 14 and accelerometer 13, the output of the D flip-flop 20*a* will go "high". The output of the D flip-flop 20*a* is connected to the gate of an SCR 28 connected between the firing capacitor 27, which will be charged due to spin, and the output through a connector to the initiator 30. When the gate of the SCR 28 is saturated, the capacitor 27 discharges through the SCR 28 into the initiator 30.

The safe and arm apparatus 100 could also have a second MEMS accelerometer or impact switch (not shown) oriented with its sense axis on a diagonal that is 45 degrees from parallel from the longitudinal inertial axis to arm the apparatus when the impact acceleration into a target or earth exceeds a predetermined threshold.

Preferably, the apparatus 100 uses many commercial components including an Analog Devices ADXL105 accelerometer, a Thiokol Propulsion Group-Elkton Division semiconductor bridge initiator, a Circle Seal Corporation Aerodyne Controls Division G-switch and an Ultralife lithium manganese dioxide battery. The apparatus, including a power supply, electronic boards and components, and pyrotechnics, was designed and tested to survive harsh launch environments such as accelerations at least to 30,000 g's and chamber pressures up to 30,000 psi by encapsulating it in STYCAST 1090 potting material.

After assembly, the apparatus was bench tested for the desired operation and optimization. Bench-level and spin tests to verify the proper threshold functioning, storage of energy, and discharge of that energy were successfully performed from February through September 1999. Numerous ground tests were performed from March through July 1999 that used the invention to successfully ignite a pyrotechnic train consisting of a low-voltage semiconductor bridge initiator and explosive material. An assembled safe and arm apparatus was successfully gas-gun tested to 55,000 g's on Aug. 12, 1999.

In another embodiment of the invention, the electrical circuit may be miniaturized onto a single board. The single board uses state-of-the-art high density chip-on-board packaging and smaller commercial versions of the accelerometer and g-switch such that the individual boards become sections of a single board.

While the invention has been described with reference to certain preferred embodiments, numerous changes, alterations and modifications to the described embodiments are possible without departing from the spirit and scope of the invention, as defined in the appended claims and equivalents thereof.

What is claimed is:

1. An electronic safe and arm apparatus disposed in a projectile having a spin axis and a spin rate, the apparatus comprising:

a battery;

a power supply board connected to the battery, the power supply board including a mechanical G-switch that closes permanently at a predetermined acceleration, and a time-delay circuit connected to the G-switch;

a firing board connected -to the power supply board, the firing board including:

an accelerometer that is oriented perpendicular to and disposed a fixed distance from the spin axis, an output of the accelerometer varying according to the fixed distance from the spin axis and the spin rate of the projectile;

a comparator connected to the output of the accelerometer wherein the comparator compares the output of the accelerometer to a threshold voltage and an output of the comparator is low when the output of the accelerometer is less than the threshold voltage and the output of the comparator is high when the output of the accelerometer exceeds the threshold voltage;

a rectifier connected to the output of the comparator;

a firing capacitor, the rectifier being connected between the battery and the firing capacitor whereby when the output of the comparator is high the comparator saturates a gate of the rectifier thereby allowing the firing capacitor to charge; and an initiator connected to an output of the firing capacitor; and a timing board connected to the power supply board and the firing board, the timing board for setting and controlling a predetermined time delay for discharge of the firing capacitor into the initiator.

2. The apparatus of claim 1 wherein the predetermined acceleration is about 18,000 g's.

3. The apparatus of claim 1 wherein a delay of the time-delay circuit connected to the G-switch is about 20 milliseconds.

4. The apparatus of claim 1 wherein the fixed distance from the accelerometer to the spin axis is about 1.7 millimeters.

5. The apparatus of claim 4 wherein when the spin rate of the projectile reaches about 30 hertz, the output of the accelerometer exceeds the threshold voltage thereby sending the output of the comparator high.

6. The apparatus of claim 1 wherein the firing board further comprises a resistor connected in series with the firing capacitor, a charge time of the firing capacitor being set by the resistor.

7. The apparatus of claim 1 wherein the firing board further comprises a drain resistor connected in parallel with the firing capacitor wherein the firing capacitor drains into the drain resistor when the gate of the rectifier is not saturated.

8. The apparatus of claim 1 further comprising a pyrotechnic train connected to the firing board.

9. The apparatus of claim 1 wherein the initiator is a semiconductor bridge initiator.

10. The apparatus of claim 8 further comprising potting material in which the apparatus is encapsulated.

11. The apparatus of claim 1 wherein the firing board further comprises a second rectifier between the firing capacitor and the initiator.

12. The apparatus of claim 11 wherein a gate of the second rectifier is connected to an output of the timing board such that when the output of the timing board is high the gate of the second rectifier is saturated and the firing capacitor discharges through the second rectifier into the initiator.

13. The apparatus of claim 11 wherein the rectifier and the second rectifier are silicon controlled rectifiers.

14. In a projectile having a spin axis and a spin rate, an electronic safe and arm apparatus, comprising:

a battery;

a power supply board connected to the battery, the power supply board including a mechanical G-switch that closes permanently at a predetermined acceleration, and a time-delay circuit connected to the G-switch;

a firing board connected to the power supply board, the firing board including:

an accelerometer that is oriented perpendicular to and disposed a fixed distance from the spin axis, an output of the accelerometer varying according to the fixed distance from the spin axis and the spin rate of the projectile;

a comparator connected to the output of the accelerometer wherein the comparator compares the output of the accelerometer to a threshold voltage and an output of the comparator is low when the output of the accelerometer is less than the threshold voltage and the output of the comparator is high when the output of the accelerometer exceeds the threshold voltage;

a rectifier connected to the output of the comparator;

a firing capacitor, the rectifier being connected between the battery and the firing capacitor whereby when the output of the comparator is high the comparator saturates a gate of the rectifier thereby allowing the firing capacitor to charge; and an initiator connected to an output of the firing capacitor; and a timing board connected to the power supply board and the firing board, the timing board for setting and controlling a predetermined time delay for discharge of the firing capacitor into the initiator.

15. The apparatus of claim 14 wherein the firing board further comprises a resistor connected in series with the firing capacitor, a charge time of the firing capacitor being set by the resistor.

16. The apparatus of claim 14 wherein the firing board further comprises a drain resistor connected in parallel with the firing capacitor wherein the firing capacitor drains into the drain resistor when the gate of the rectifier is not saturated.

17. The apparatus of claim 14 further comprising a pyrotechnic train connected to the firing board.

18. The apparatus of claim 17 further comprising potting material in which the apparatus is encapsulated.

19. The apparatus of claim 14 wherein the firing board further comprises a second rectifier between the firing capacitor and the initiator.

20. The apparatus of claim 19 wherein a gate of the second rectifier is connected to an output of the timing board such that when the output of the timing board is high the gate of the second rectifier is saturated and the firing capacitor discharges through the second rectifier into the initiator.

* * * * *